US011083922B2

(12) United States Patent
Ryan et al.

(10) Patent No.: US 11,083,922 B2
(45) Date of Patent: Aug. 10, 2021

(54) INCLINER APPARATUS

(71) Applicant: InclineRx LLC, Seattle, WA (US)

(72) Inventors: David Richard Ryan, Langley, WA (US); Aimée Lenoue Jacobson, Seattle, WA (US)

(73) Assignee: InclineRx LLC, Seattle, WA (US)

( * ) Notice: Subject to any disclaimer, the term of this patent is extended or adjusted under 35 U.S.C. 154(b) by 0 days.

(21) Appl. No.: 15/950,944

(22) Filed: Apr. 11, 2018

(65) Prior Publication Data

US 2019/0314664 A1 Oct. 17, 2019

(51) Int. Cl.

*A63B 21/00* (2006.01)
*A63B 23/02* (2006.01)
*A63B 22/16* (2006.01)

(52) U.S. Cl.

CPC .... *A63B 21/0004* (2013.01); *A63B 21/00181* (2013.01); *A63B 22/16* (2013.01); *A63B 23/0205* (2013.01); *A63B 23/0233* (2013.01); *A63B 2208/0238* (2013.01); *A63B 2208/0252* (2013.01)

(58) Field of Classification Search

CPC ... A63B 21/0004; A63B 22/16; A63B 26/003; A63B 23/0233; A63B 21/00181; A63B 23/0205; A63B 2208/0252; A63B 2208/0238; A63B 1/00; A61B 22/14–18; A47D 9/02–04; A47C 3/029

USPC ..... 5/101

See application file for complete search history.

(56) References Cited

U.S. PATENT DOCUMENTS 1,979,716 A * 11/1934 Terry ..... A63B 22/0076 482/72
D168,270 S * 11/1952 Lamb ..... D6/348
D185,563 S * 6/1959 Parker ..... 5/105
3,010,719 A 11/1961 Johnson
D286,802 S * 11/1986 Ahlberg ..... D21/688
4,919,481 A * 4/1990 Garabedian ..... A47C 3/029 297/271.6
5,213,394 A 5/1993 Tattrie
D365,610 S * 12/1995 Fraser ..... D21/688

(Continued)

OTHER PUBLICATIONS

"BodySlant," *EvolutionHealth.com*, URL=http://www.evolutionhealth.com/bodyslant/, download date Apr. 24, 2018.

(Continued)

*Primary Examiner* — Nyca T Nguyen
(74) *Attorney, Agent, or Firm* — Seed IP Law Group LLP

(57) ABSTRACT

Wellness equipment is provided in the form of an incliner apparatus that can also serve as furniture. The incliner apparatus includes a body support structure and at least one ground engaging rocker coupled to the body support structure to support a user at a variable angular orientation or pitch in response to a position of the user on the body support structure. The incliner apparatus is configured such that the body support structure may assume a horizontal configuration when the incliner apparatus is in a state of equilibrium, and such that the body support structure may assume a declined configuration or an inclined configuration when the user lies on the body support structure with a center of gravity of the user offset from a central reference plane of the incliner apparatus.

15 Claims, 5 Drawing Sheets

(56) References Cited

U.S. PATENT DOCUMENTS 5,643,164 A * 7/1997 Teff ..... A63B 22/16 482/146
D396,078 S * 7/1998 Atashkarian ..... D21/668
5,795,277 A * 8/1998 Bruntmyer ..... A63B 21/0004 280/87.041
6,461,205 B1 * 10/2002 Banba ..... B63H 20/10 440/61 D
7,213,277 B1 * 5/2007 Hsieh ..... A47C 3/029 5/101
7,276,033 B2 * 10/2007 Phillips ..... A61H 1/003 601/23
D604,374 S * 11/2009 Bizzell ..... D21/688
7,632,218 B2 * 12/2009 Sannes ..... A63B 22/18 482/146
7,951,056 B2 * 5/2011 Radzwill ..... A63B 21/078 482/142
D648,403 S * 11/2011 Hanifee ..... D21/688
8,292,837 B2 * 10/2012 Du ..... A61H 15/00 482/137
D677,915 S * 3/2013 Chadwick ..... D6/348
8,734,308 B1 * 5/2014 Joslin ..... A63B 22/16 482/142
D778,377 S * 2/2017 Daniel ..... D21/688
2002/0187886 A1 * 12/2002 Wu ..... A63B 23/03575 482/142
2004/0014571 A1 * 1/2004 Haynes ..... A63B 21/0004 482/142
2007/0149374 A1 * 6/2007 Carlson ..... A63B 22/16 482/146
2013/0197403 A1 * 8/2013 Sevy ..... A63B 21/0442 601/5
2015/0165266 A1 * 6/2015 Powers ..... A63B 22/16 482/142
2015/0190679 A1 * 7/2015 Carbone ..... A63B 26/003 482/146
2015/0297946 A1 * 10/2015 Kelley ..... A63B 69/0093 482/129
2017/0232302 A1 * 8/2017 Dedvukaj ..... A63B 26/003 482/123
2018/0333608 A1 * 11/2018 Supernault ..... A63B 26/003
2019/0329094 A1 * 10/2019 Strobel ..... A63B 22/18

OTHER PUBLICATIONS

"Gravity Pal Low Angle Inversion Tables," URL=http://www.gravitypal.com/, download date Apr. 24, 2018.
"In-Trinity Board," URL=https://in-trinity.com/the-board/, download date Apr. 24, 2018.
"Kahuna Massage Chair Space-Saving Zero-Gravity Full-Body Recliner LM6800 with yoga & heating therapy (Brown)," *Amazon*, URL=https://www.amazon.com/Space-Saving-Kahuna-Massage-Chair-LM6800/dp/B01M24RKQY, download date Apr. 24, 2018.
"Teeter," URL=https://teeter.com/hang-ups/, download date Apr. 24, 2018.
"Wellness Pad by Technogym," *Thrive Global*, URL=https://shop.thriveglobal.com/collections/body/products/wellness-pad, download date Apr. 24, 2018.
"Zero Gravity Chairs," *Relax the Back*, URL=https://www.relaxtheback.com/recliners/zero-gravity.html, download date Apr. 24, 2018.
International Search Report and Written Opinion of the International Searching Authority, in International Application No. PCT/US2019/026387, dated Jun. 14, 2019, 10 pages.

* cited by examiner

INCLINER APPARATUS

BACKGROUND

Technical Field

This disclosure generally relates to wellness equipment, including, in particular, wellness equipment that may be utilized to support a user in an inverted position, such as a low angle inverted position.

Description of the Related Art

Various types of wellness equipment are known for supporting a user in an inverted position for therapeutic and other purposes, including inversion tables and fixed angle slant boards. Such known types of equipment, however, may suffer from a variety of deficiencies and drawbacks, including, for example, being overly complex, bulky and/or cumbersome or difficult to use. In particular, in the case of a fixed angle slant board, it can be cumbersome or difficult for one to get on and off the slant board, especially for those who lack sufficient abdominal strength to lower themselves onto the slant board and raise themselves from the slant board smoothly and without risk of injury.

BRIEF SUMMARY

Embodiments disclosed herein provide wellness equipment in the form of incliner apparatuses which are particularly well adapted for supporting a user in a low angle inverted position and providing other functionality. Embodiments of the incliner apparatuses described herein may in some instances serve or double as a piece of furniture, such as a rocking bench, a seat, an ottoman, a footrest, a coffee table or the like. In some instances, the incliner apparatuses may be characterized or described as wellness furniture, i.e., furniture that promotes or enhances the health or wellbeing of the user.

According to one embodiment, an article of wellness furniture may be summarized as including a body support structure and at least one ground engaging rocker coupled to the body support structure to support the body support structure and a user at a variable angular orientation relative to a ground surface in response to a position of the user on the body support structure. The article of wellness furniture may be configured such that the body support structure assumes a horizontal configuration when the article of wellness furniture is in a state of equilibrium, and such that the body support structure assumes a declined configuration when a user lies on the body support structure with a center of gravity of the user offset from a central reference plane of the article of wellness furniture.

The ground engaging rockers may be configured to enable the body support structure to transition from the horizontal configuration to the declined configuration via a change in the location of the center of gravity of the user as the user moves to a lying position from an upright seated position generally aligned with the central reference plane. Similarly, the ground engaging rockers may be configured to transition from the declined configuration back to the horizontal configuration via a change in the location of the center of gravity of the user as the user moves from a lying position to an upright seated position generally aligned with the central reference plane.

Additionally, the ground engaging rockers may be configured to enable the body support structure to transition from the horizontal configuration to an inclined configuration via a change in the location of the center of gravity of the user as the user moves to a seated forward bend position from an upright seated position generally aligned with the central reference plane. Similarly, the ground engaging rockers may be configured to enable the body support structure to transition from the inclined configuration back to the horizontal configuration via a change in the location of the center of gravity of the user as the user moves from a seated forward bend position to the upright seated position generally aligned with the central reference plane.

In some instances, the article of wellness furniture may be configured to enable a user to selectively change a degree to which the body support structure and the user declines or inclines by adjusting his or her position along a longitudinal length of the body support structure. For example, a user may shift or reposition his or her body along a longitudinal length of the wellness furniture to change the location of his or her center of gravity relative to the wellness furniture to thereby cause the wellness furniture to transition to a deeper or shallower decline or incline position.

The ground engaging rockers may include, for example, an arcuate profile that is configured to enable the body support structure to transition smoothly and slowly from the horizontal configuration to the declined configuration and/or from the horizontal configuration to the inclined configuration. In some instances, the ground engaging rockers may include an arcuate profile that enables the angular orientation of the body support structure to range from about a fifteen degree decline, to horizontal, to about a fifteen degree incline.

Preferably, the body support structure is configured to support a user in a flat lying position in which the head, torso and legs of the user are aligned or generally aligned in the same plane.

In some instances, the wellness furniture may include a pair of laterally offset ground engaging rockers that extend from an underside of the body support structure to engage the ground along opposing longitudinal sides of the article of wellness furniture. In such instances, the ground engaging rockers may provide a stable base for the body support structure (which may also be characterized as a seat structure, a footrest structure, a tabletop structure or other furniture structure) to prevent lateral, side-to-side rocking or tipping of the wellness furniture.

According to some embodiments, the body support structure may comprise a plank serving as the body support structure, a pair of ground engaging rockers, and a plurality of transverse brace members extending between the ground engaging rockers. The plank may have a length that exceeds an average height of an adult human and a width that exceeds three-quarters of an average shoulder width of an adult human to provide a platform sufficient to support a user in a lying position. In some instances, an upper support surface of the body support structure may be supported between about seven to about twelve inches above the ground by the ground engaging rockers when in the horizontal configuration. In other instances, the wellness furniture may be scaled or sized differently, while providing similar functionality described of other embodiments described herein.

The wellness furniture may further include a device for assisting a user in transitioning the wellness furniture between the declined configuration and the horizontal configuration and/or the inclined configuration and the horizontal configuration. For example, a strap may be provided to assist a user in transitioning from a declined lying position on the body support structure to an upright seated position or from the upright seated position to the lying position. The strap may be removably coupled to the body support structure for selective use.

According to another embodiment, a wellness apparatus may be summarized as including: a body support structure configured to support a user in a flat lying position; and a pair of laterally offset ground engaging rockers coupled to the body support structure to engage the ground along opposing longitudinal sides of the wellness apparatus and support the body support structure at a variable angular orientation relative to the ground in response to a position of a user on the body support structure. The wellness apparatus may be configured such that the body support structure assumes a generally horizontal configuration when the wellness apparatus is in a state of equilibrium, and such that the body support structure assumes a declined configuration when a user lies on the body support structure with a center of gravity of the user offset from a central reference plane of the wellness apparatus.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known components, structures or features associated with wellness equipment, including inversion apparatuses, may not be shown or described in detail to avoid unnecessarily obscuring descriptions of the embodiments.

Unless the context requires otherwise, throughout the specification and claims which follow, the word "comprise" and variations thereof, such as "comprises" and "comprising," are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments disclosed herein include wellness equipment in the form of incliner apparatuses which are particularly well adapted for supporting a user in a low angle inverted position and providing other functionality. Embodiments may be characterized or described as an article of wellness furniture (e.g., a rocking bench or seat) that enhances wellness by providing a user with a manipulable apparatus for low angle inversion therapy and other uses. In some instances, the apparatus may provide or serve a function or other purpose apart from low angle inversion therapy that is reminiscent of traditional articles of furniture. For example, embodiments of the incliner apparatuses described herein may in some instances be used in a manner similar to an ottoman, a footrest, or a low height table, such as a coffee table or the like. In some instances, the incliner apparatuses may be characterized or described as serving as an article of wellness equipment and as an article of furniture, thereby defining a new class of product or otherwise blurring the lines between traditional classes of products.

Figure 1:
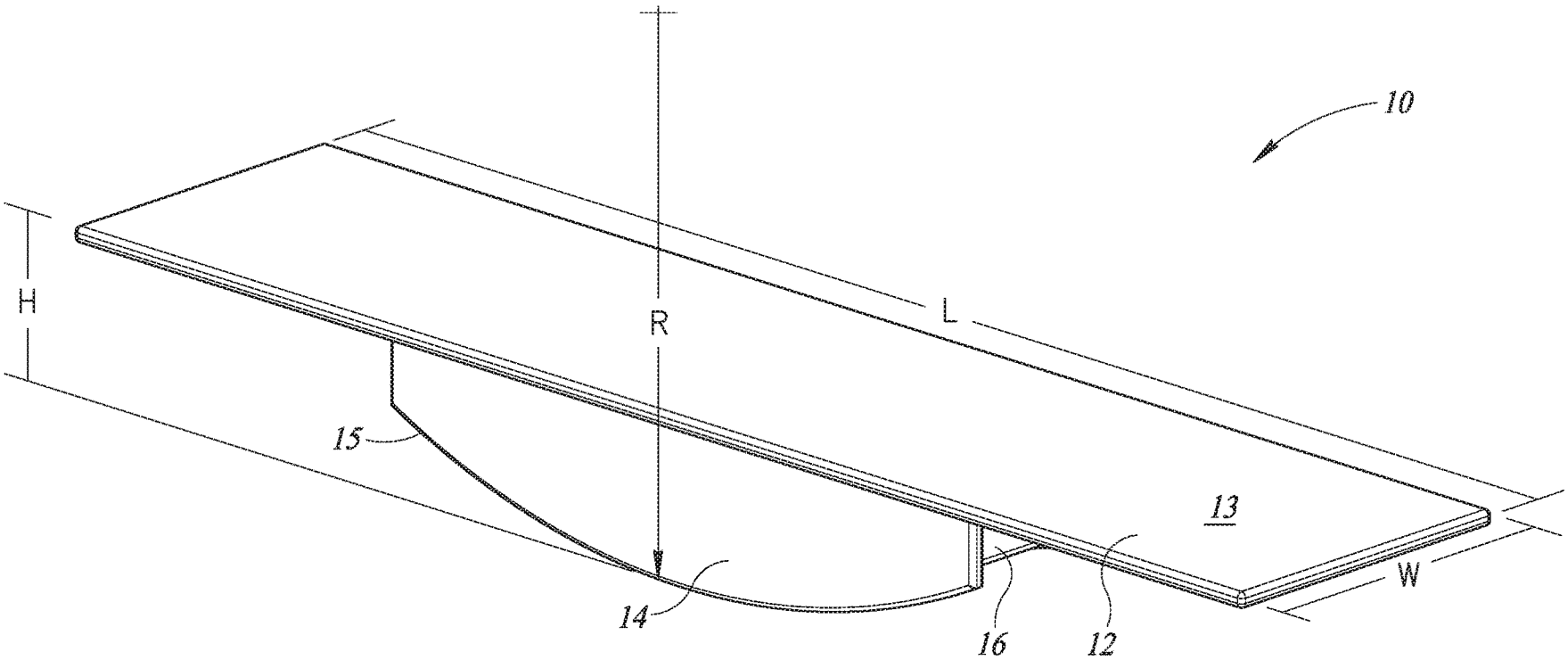
FIG. 1 is a perspective view of an article of wellness equipment, according to one example embodiment, in the form of an incliner apparatus that is configured to support a user in a flat lying position at a variable angular orientation with the incliner apparatus shown in a horizontal (equilibrium) configuration.
Figure 2:
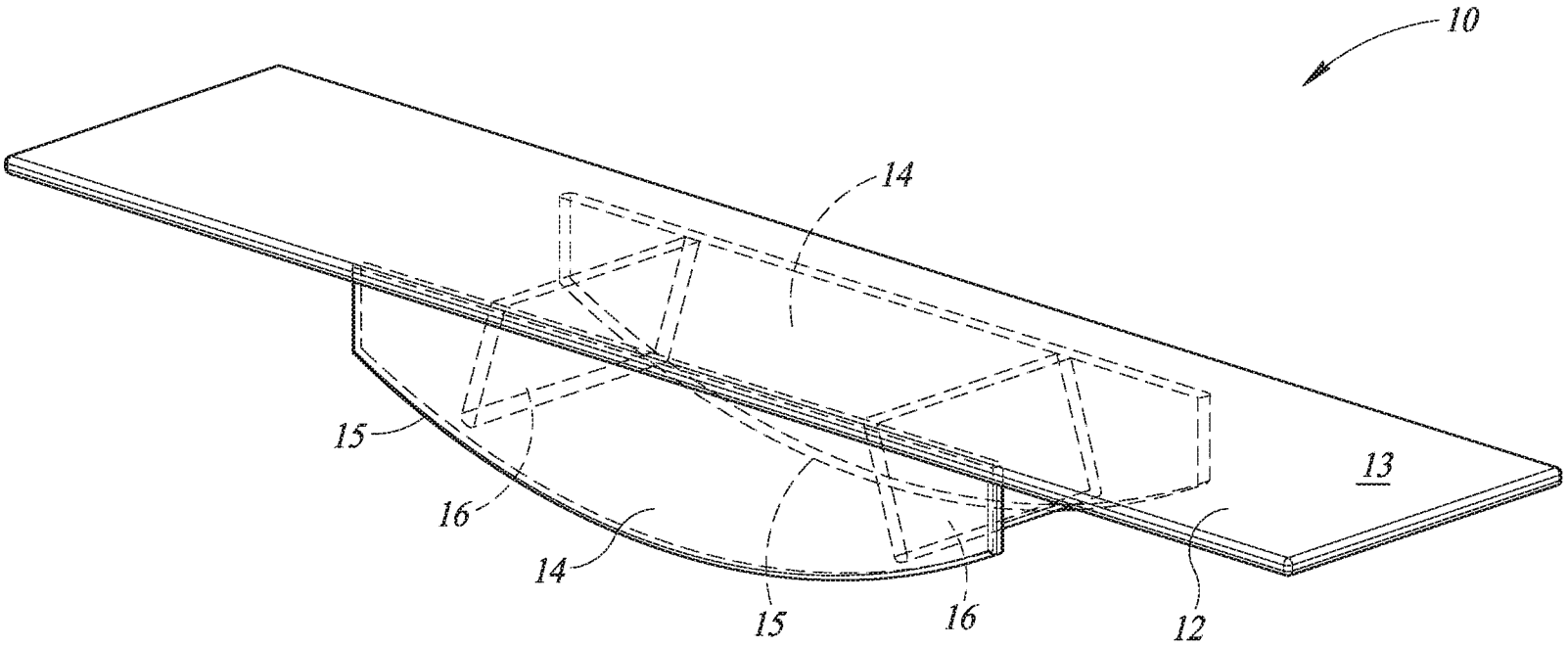
FIG. 2 is a perspective view of the incliner apparatus of FIG. 1 shown in the horizontal configuration but with hidden lines visible to reveal additional details of the example embodiment.
Figure 3:
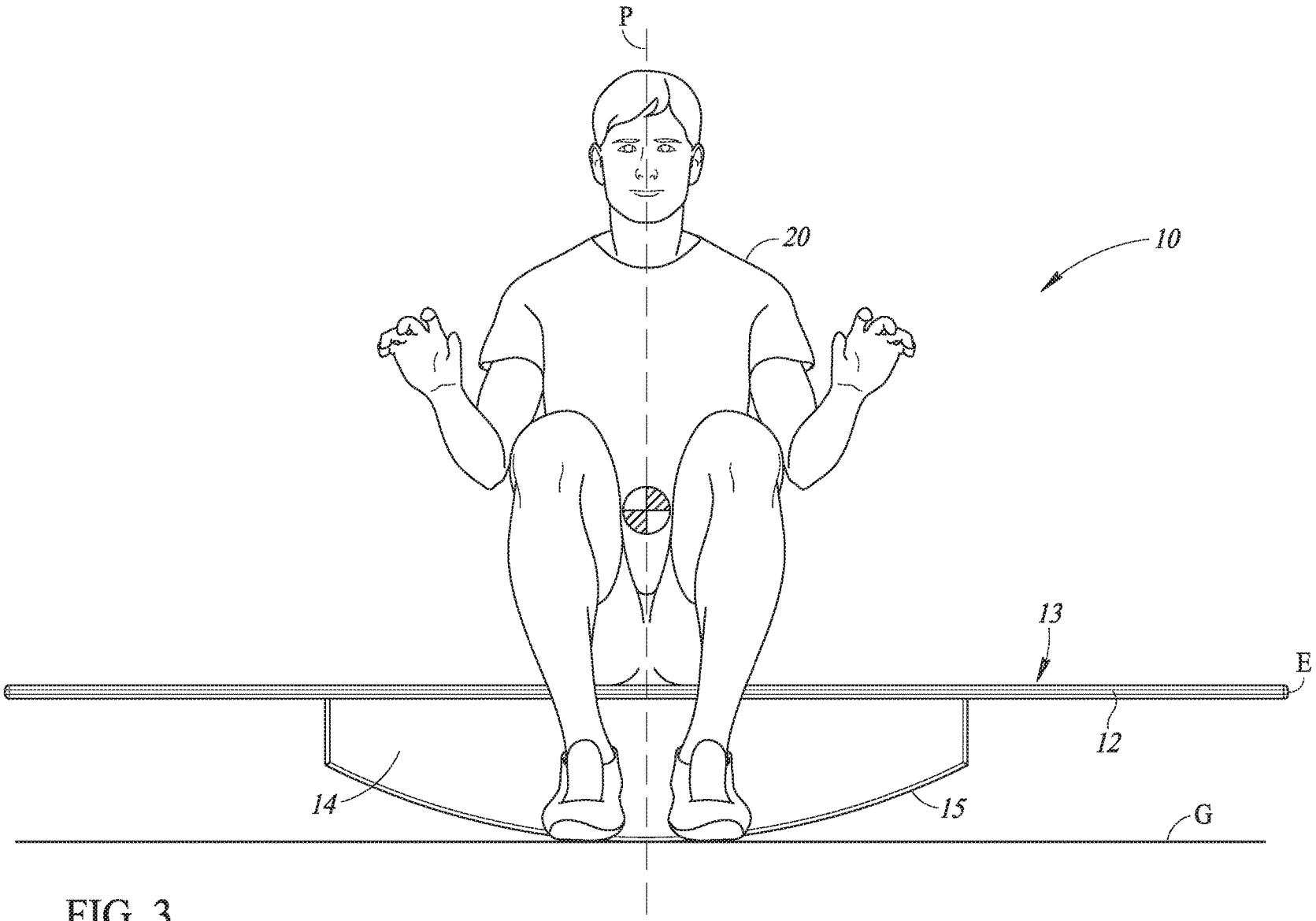
FIG. 3 is a side view of the incliner apparatus of FIG. 1 in the horizontal configuration with a user seated on the incliner apparatus with the user's center of gravity aligned with a central plane of the incliner apparatus.
Figure 4:
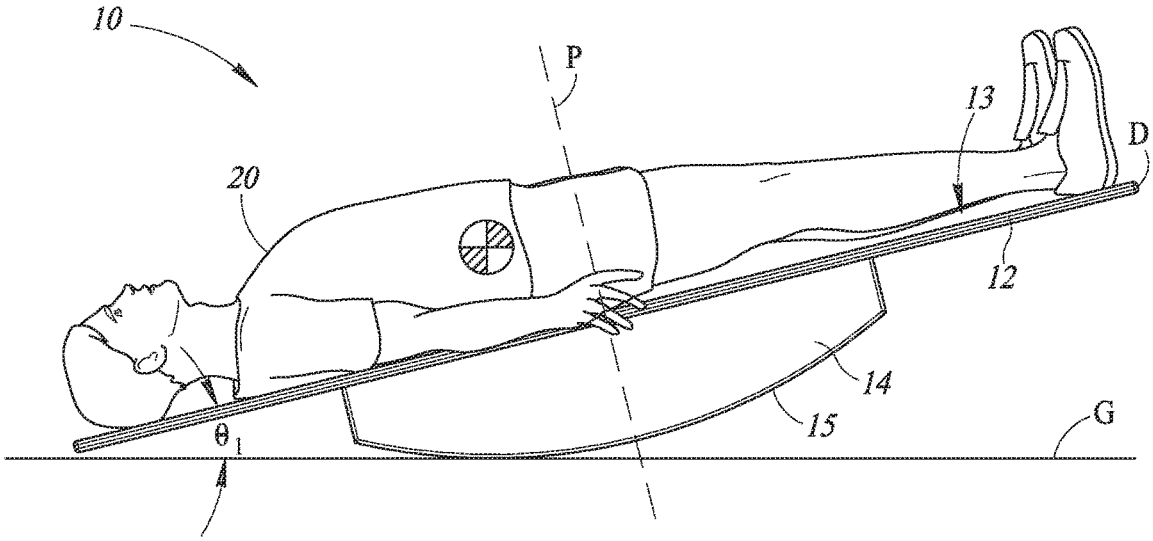
FIG. 4 is a side view of the incliner apparatus of FIG. 1 in a declined configuration in which the user is lying flat on the incliner apparatus.
Figure 5:
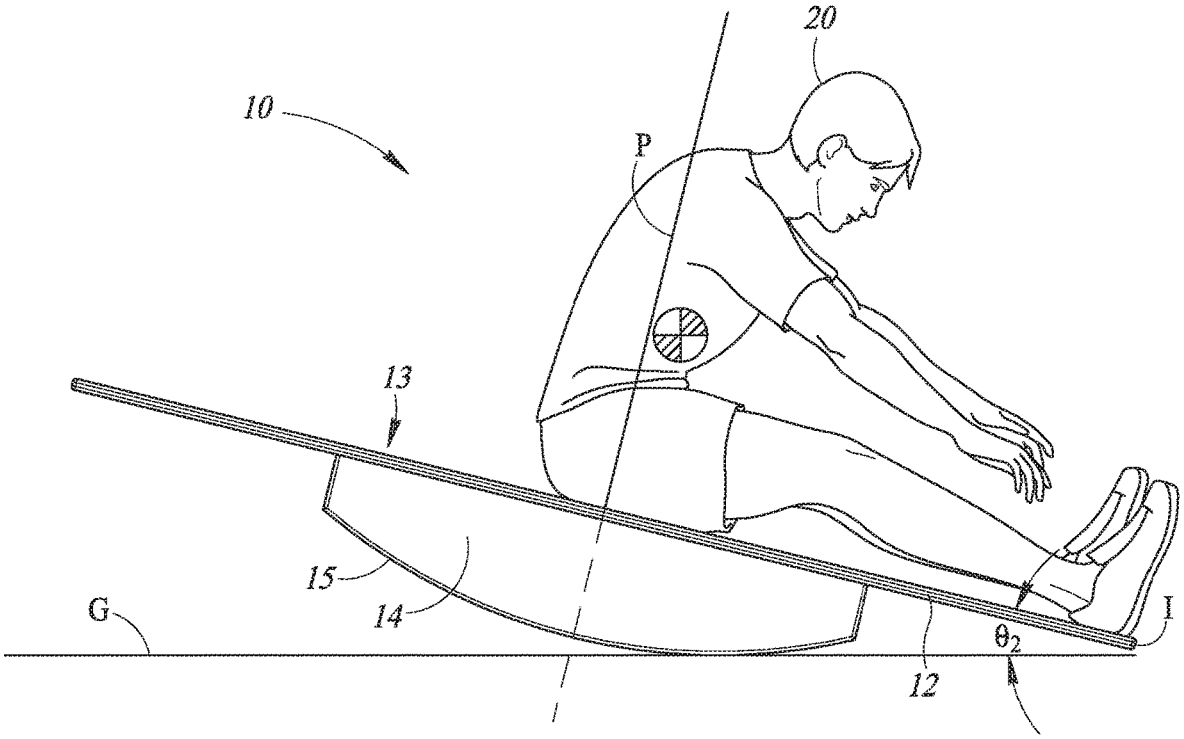
FIG. 5 is a side view of the incliner apparatus of FIG. 1 in an inclined configuration in which the user is seated and bent forward on the incliner apparatus.
Figure 6:
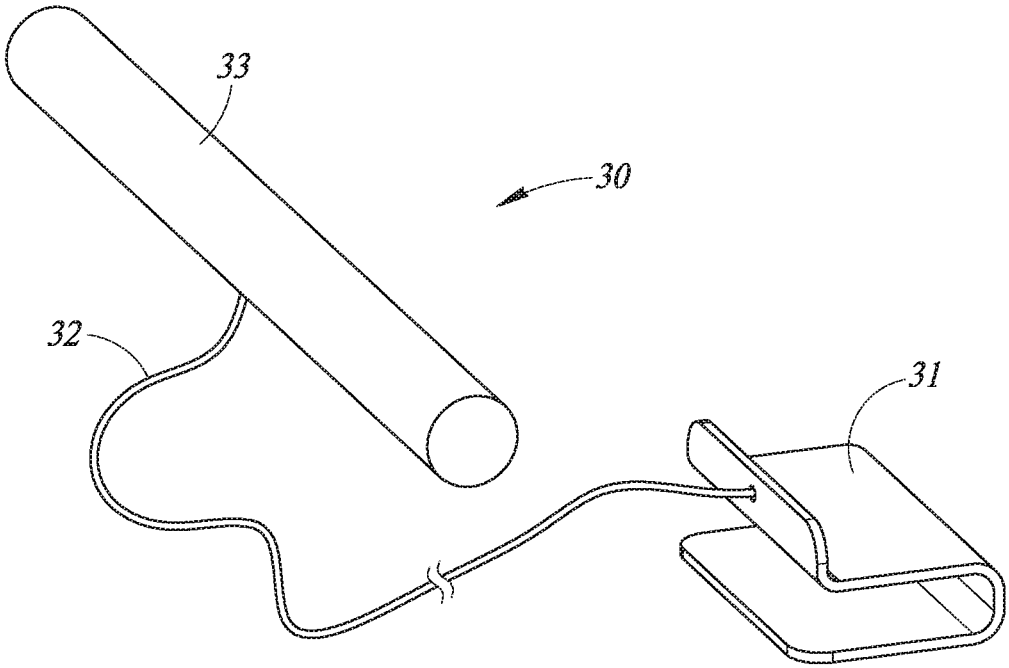
FIG. 6 is a perspective view of an accessory device for assisting a user in transitioning the incliner apparatus of FIG. 1 from the horizontal configuration shown in FIG. 3 to the declined configuration shown in FIG. 4, or vice versa.
Figure 7:
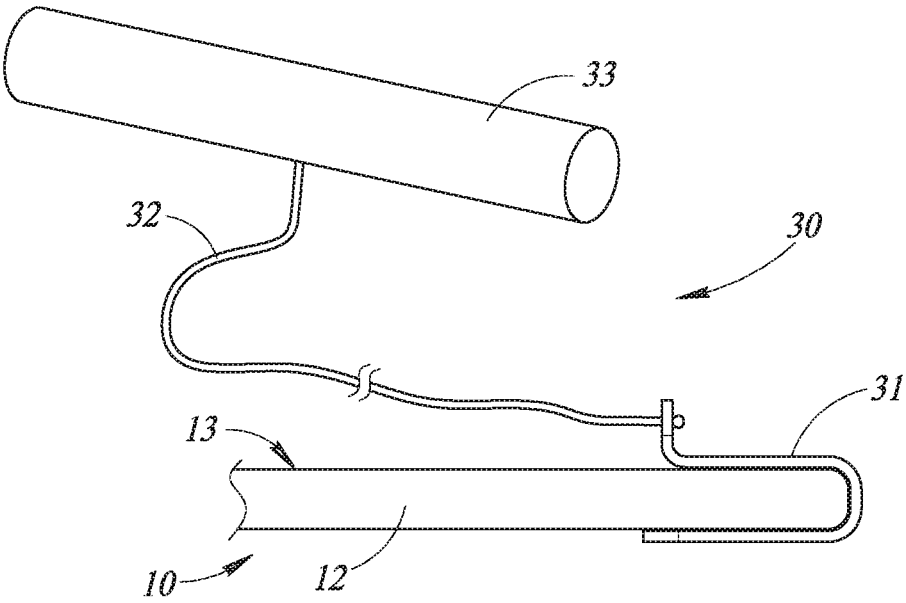
FIG. 7 is side view of the accessory device of FIG. 6 removably attached to an end of the incliner apparatus of FIG. 1.

FIGS. 1 through 5 show an incliner apparatus 10 according to one example embodiment, and FIGS. 6 and 7 show an accessory device 30 which may be used to assist a user in using the incliner apparatus 10 for therapeutic or other purposes. More particularly, the accessory device 30 may be used to assist a user in moving into or out of a low angle inverted position on the incliner apparatus 10. When the incliner apparatus 10 is not in active use, the incliner apparatus may serve as a coffee table or the like. Consequently, the incliner apparatus 10 may be characterized or described as an article of wellness furniture. With reference to FIGS. 1 through 5, the incliner apparatus 10 includes a body support structure 12 and a pair of opposing laterally offset ground engaging rockers 14 that extend from an underside of the body support structure 12 to engage the ground G along opposing longitudinal sides of the incliner apparatus 10 to support the body support structure 12 and a user above the ground G at a variable angular orientation in response to a position of the user 20 on the body support structure 12. More particularly, the incliner apparatus 10 is configured such that the body support structure 12 assumes a horizontal configuration E when the incliner apparatus 10 is in a state of equilibrium as shown in FIGS. 1 through 3, and assumes a declined configuration D or an inclined configuration I when a user 20 lies on the body support structure 12 with a center of gravity of the user 20 offset from a central reference plane P of the incliner apparatus 10, as shown in FIGS. 4 and 5, respectively.

The incliner apparatus 10 takes advantage of the unique center of gravity of the human body, which is situated above the actual center of the body, so that when a user lies horizontally on the body support structure 12, as shown in FIG. 4, it naturally tilts, moving the user's head closer to the ground G and the feet further from the ground G, and thereby lowering the user's head below the user's heart. Advantageously, the body support structure 12 may be configured to support a user's body in a straight line so that the user's hips are not in a sitting position and so that the user's feet are above the user's hips, and so that the user's hips are above the user's heart. This can be particularly beneficial in opening up the user's hip flexors and countering the effects of a sedentary lifestyle in which the user is often in a seated position. It can also be particularly beneficial in improving blood flow and oxygen delivery to the brain or other organs.

The incliner apparatus 10 is a tool for people, which not only counters the drag of gravity and the stagnation and stiffness of too much sitting, but also provides a simple platform for recovery from exertion, stress and age. Regular use of the incliner apparatus 10 is intended to foster a meditative sensory awareness that can become a reflective and transformative process for the body, mind and spirit. Benefits of utilizing the incliner apparatus 10 may include, among other things: (i) reduced stress by improving one's sense of relaxation, vitality and calm, by generating physical, mental, emotional energy, and/or by expanding self-awareness, reflection and clarity of thought; (ii) improved blood circulation and blockage prevention; and (iii) reduction or elimination of back pain and muscle tension. In general, use of the incliner apparatus 10 may counter many ailments arising from sedentary, desk-bound lifestyles.

The incliner apparatus 10 may be used as an article of furniture and as a self-care tool to improve personal well-being. It may be used in a business environment in renewal rooms, meditation rooms, wellness rooms and in lactation rooms to add another function when not needed for its therapeutic use. Again, the incliner apparatus 10 is intended to foster a meditative sensory awareness that can become a reflective and transformative process for the body, mind and spirit. The incliner apparatus 10 is an adaptive tool that can be used in conjunction with existing self-care practices and other activities such as, but not limited to, yoga, stretching, meditation, exercise, visualization, physical therapy, occupational therapy and injury recovery.

According to some embodiments, the incliner apparatus 10 is configured to provide a slow, gentle recline into a low angle inverted position ranging from a decline angle $\theta_1$ of zero to about fifteen degrees. The variability of the degree of decline may be particularly beneficial for those users who need or desire a gentler inversion angle than the maximum inversion angle. In some instances, the maximum inversion angle may be fourteen degrees, or about fourteen degrees, as shown in the example embodiment of FIG. 4. Advantageously, the user may assume a lying position on the incliner apparatus 10 in which the user's feet are above the user's hips and the user's hips are above the user's heart, with the user's body in a straight or substantially straight line so the hips are not in a sitting position, as also shown in the example embodiment of FIG. 4.

According to some embodiments, the incliner apparatus 10 is configured to assist a user in getting up from a low angle inverted position by returning to a horizontal equilibrium position from which the user can then easily stand up from, as shown in FIG. 3. This can reduce the occurrence of or otherwise prevent one from getting light-headed immediately following a low angle inversion session.

According to some embodiments, the incliner apparatus 10 may also provide for forward tilt positioning that allows gravity to assist a user in stretching forward over the user's legs in a forward motion, as shown in FIG. 5.

Still further, the incliner apparatus 10 may be used in a wide variety of other activities, such as, without limitation, yoga, napping, balancing and strength training.

With continued reference to the example embodiment of the incliner apparatus 10 shown in FIGS. 1 through 5, the ground engaging rockers 14 may be configured to enable the body support structure 12 to transition from the horizontal (equilibrium) configuration E shown in FIG. 3 to the declined configuration D shown in FIG. 4 via a change in a location of the center of gravity of the user as the user moves to a lying position from an upright seated position generally aligned with the central reference plane P. The ground engaging rockers 14 may include an arcuate ground engaging profile 15 that promotes a slow gradual transition to the declined configuration D. For example, the ground engaging rockers 14 may have a large radius of curvature R, such as thirty, thirty-five or forty inches or more, on an aft portion thereof to enable the incliner apparatus 10 to slowly rock back into the declined configuration D as the user lies down on the incliner apparatus 10. Likewise, the ground engaging rockers 14 may be configured to enable the body support structure 12 to transition back from the declined configuration D to the horizontal (equilibrium) configuration E via a change in a location of the center of gravity of the user as the user moves from the lying position, as shown in FIG. 4, back to an upright seated position generally aligned with the central reference plane P, as shown in FIG. 3.

The ground engaging rockers 14 may also be configured to enable the body support structure 12 to transition from the horizontal (equilibrium) configuration E to the inclined configuration I shown in FIG. 5 via a change in a location of the center of gravity of the user as the user moves to a seated forward bend position from an upright seated position generally aligned with the central reference plane P. The ground engaging rockers 14 may include an arcuate ground engaging profile 15 that promotes a slow gradual transition to the declined configuration D. For example, the ground engaging rockers 14 may have a large radius of curvature R, such as thirty, thirty-five or forty inches or more, on a forward portion thereof, to enable the incliner apparatus 10 to slowly rock forward into the inclined configuration I as the user bends forward on the incliner apparatus 10. Likewise, the ground engaging rockers 14 may be configured to enable the body support structure 12 to transition back from the inclined configuration I to the horizontal (equilibrium) configuration E via a change in a location of the center of gravity of the user as the user moves from the seated forward bend position, as shown in FIG. 5, to the upright seated position generally aligned with the central reference plane P, as shown in FIG. 3.

Advantageously, the ground engaging rockers 14 of the example embodiment of the incliner apparatus 10 shown in FIGS. 1 through 5 includes an arcuate profile that enables the angular orientation of the body support structure 12 to range from horizontal to a decline angle $\theta_1$ of about fifteen degrees, and from horizontal to an incline angle $\theta_2$ of about fifteen degrees.

Advantageously, the example embodiment of the incliner apparatus 10 shown in FIGS. 1 through 5 is configured to enable a user to selectively change a degree to which the body support structure 12 declines or inclines by adjusting his or her position along a longitudinal length of the body support structure 12. For instance, a user may shift his or her body slightly aft when in a lying position to increase the degree to which the body support structure 12 declines, or a user may shift his or her body slightly forward when in a lying position to decrease the degree to which the body support structure 12 declines. Similarly, a user may shift his or her body slightly forward when in a seated forward bend position to increase the degree to which the body support structure 12 inclines, or a user may shift his or her body slightly aft when in a seated forward bend position to decrease the degree to which the body support structure 12 inclines.

With continued reference to the example embodiment of the incliner apparatus 10 shown in FIGS. 1 through 5, the body support structure 12 is preferably configured to support a user in a flat lying position. According to the illustrated embodiment, the body support structure 12 is an elongate plank structure that includes a planar body support surface 13. In other instances, the body support structure 12 may include a complex surface profile, including one or more portions that nest with corresponding portions of the user's body, such as, for example, a lumbar support structure that nests with the user's lower back. Accordingly, the body support structure 12 may be, but is not necessarily, flat or essentially flat. In addition, the body support structure 12 may be provided with a cushion structure, an anti-slip structure or other structures that enhance user comfort and/or user interaction with the incliner apparatus 10.

According to the example embodiment shown in FIGS. 1 through 5, the incliner apparatus 10 includes the body support structure 12, the ground engaging rockers 14, and a plurality of transverse brace members 16 extending between the ground engaging rockers 14. In some instances, the body support structure 12, the ground engaging rockers 14 and the brace members 16 may be provided as substantially planar structures that may be densely packaged in a single container (e.g., corrugated paperboard container) with suitable hardware for facilitating the sale and transport of the incliner apparatus 10 for subsequent assembly by an end-user. In one particularly advantageous embodiment, the ground engaging rockers 14 and the brace members 16 may be located against and within the outer profile of the body support structure 12 in a packaged arrangement.

Example dimensions of the example embodiment of the incliner apparatus 10 will now be provided with reference to FIG. 1. The incliner apparatus 10 may have an overall longitudinal length L, for example, of between about 66 inches and about 80 inches, or between about 70 inches and about 76 inches, or of about 72 inches. The incliner apparatus 10 may have an overall width W, for example, of between about 12 inches and about 20 inches, or between about 14 inches and about 18 inches, or of about 16 inches. The incliner apparatus 10 may have a height H when in the horizontal (equilibrium) position E, for example, of between about 5 inches and about 14 inches, or between about 7 inches and about 12 inches, or of about 9 inches. At least a portion of the arcuate ground engaging profile 15 of the ground engaging rockers 14 may have a radius of curvature R, for example, of between about 30 inches and about 50 inches, or between about 35 inches and about 45 inches, or of about 40 inches. Accordingly, a center of curvature of the arcuate profile of the ground engaging rockers 14 may be located between about 16 inches above an upper surface of the incliner apparatus 10 (i.e., 30 inches minimum radius of curvature minus a maximum height of 14 inches) and about 45 inches above the upper surface of the incliner apparatus 10 (i.e., 50 inches maximum radius of curvature minus a minimum height of 5 inches). According to such embodiments, the incliner apparatus 10 may be well suited for use by nearly all or most adults as a low angle inversion device. The incliner apparatus 10 may also serve as a low height coffee table or the like.

In some instances, the body support structure 12 of the incliner apparatus 10 may comprise a plank structure having a length that defines the overall length L of the incliner apparatus 10 and a width that defines the overall width W of the incliner apparatus 10. The length of the plank structure may exceed an average height of an adult human, and the width of the plank may exceed three-quarters of an average shoulder width of an adult human. The plank structure may be formed of a single plank member or of a plurality of plank members joined or coupled together. Similarly, in such instances, the incliner apparatus 10 may be well suited for use by nearly all or most adults as a low angle inversion device.

With reference now to FIGS. 6 and 7, an accessory device 30 may be provided to assist a user in utilizing the incliner apparatus 10 for therapeutic or other purposes. For instance, the accessory device 30 may be used to assist a user in moving into or out of a low angle inverted position on the incliner apparatus 10.

According to the example embodiment shown in FIGS. 6 and 7, the accessory device 30 comprises a clip device 31, which may be removably coupled to an end of the body support structure 12 of the incliner apparatus 10. A strap or cord 32 extends from the clip device 31 to a handle member 33, which may be used by a user to slowly lower his or her body into the lying position shown in FIG. 4, for example, or to assist in pulling himself or herself back up to a seated position from a lying position, or for otherwise assisting the user in positioning himself or herself on the incliner apparatus 10 or in otherwise using the incliner apparatus 10 for therapeutic or other purposes (e.g., moving into or out of a yoga pose).

In some instances, one or more handles or lugs may be coupled to or integrally formed in the incliner apparatus 10 to assist a user in positioning or repositioning himself or herself on the incliner apparatus 10. In such instances, the handles or lugs may also be used to carry or otherwise move the incliner apparatus 10.

It is appreciated that embodiments of the incliner apparatuses 10 disclosed herein may serve solely as a therapeutic device, an exercise device or other device that promotes well-being rather than use as furniture.

In addition, although the example embodiment of the incliner apparatus 10 shown in FIGS. 1 through 5 is shown as a rigid structure, it is appreciated that aspects of the incliner apparatus 10, such as the ground engaging rockers 14, may be movably (e.g., rotatably) coupled to the body support structure 12 to facilitate collapsing of the ground engaging rockers 14 against the body support structure 12 for storage of the incliner apparatus 10 during periods of nonuse. In addition, the body support structure 12 may be providing as a foldable structure such that the incliner apparatus 10 may be folded into a smaller profile (e.g., folded in half) for storage or transport. Still further, the incliner apparatus 10 may be configured to be readily disassembled for storage or transport. Accordingly, embodiments are not limited to fixed rigid structures, but encompass variations in which the profile of the incliner apparatus 10 may be manipulated or changed by user.

Moreover, features and aspects of the embodiments described above can be combined to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An article of wellness furniture, comprising:

a body support structure comprising a plank configured to support a user in a flat lying position and having a longitudinal length between about 66 inches and about 80 inches such that, when the user lies on the plank, the user's head is supported by one longitudinal end of the plank and the user's feet are supported by another longitudinal end of the plank; and a first ground engaging rocker and a second ground engaging rocker coupled to the body support structure and shaped to support the body support structure at a variable angular orientation relative to a ground surface in response to a position of the user on the plank of the body support structure, the first and second ground engaging rockers being oriented relative to the body support structure to enable the longitudinal ends of the plank to pitch up and down in response to the position of the user, and the first ground engaging rocker positioned at a first lateral side of the plank and the second ground engaging rocker positioned at a second lateral side of the plank opposite the first lateral side to prevent the plank from tipping side to side as the longitudinal ends pitch up and down during use, wherein the article of wellness furniture is configured such that the body support structure assumes a horizontal configuration when the article of wellness furniture is in a state of equilibrium, and assumes a declined configuration when the user lies on the plank of the body support structure with a center of gravity of the user offset from a central reference plane of the article of wellness furniture that extends transverse to the plank between the first lateral side and the second lateral side, wherein a ground engaging profile of the first and second ground engaging rockers and an upper support surface of the plank are each symmetric about the central reference plane to enable the article of wellness furniture to be used in a bi-directional manner, wherein the upper support surface of the plank is between about five and about fourteen inches above the ground when in the horizontal configuration, and wherein each of the first and second ground engaging rockers includes an arcuate profile having a radius of curvature between about 30 inches and about 50 inches to assist in transitioning the body support structure smoothly between the horizontal configuration and the declined configuration, and such that a center of curvature of the arcuate profile of each of the first and second ground engaging rockers is located between about 16 inches and about 45 inches above the upper support surface of the plank.

2. The article of wellness furniture of claim 1 wherein the first and second ground engaging rockers are configured to enable the body support structure to transition from the horizontal configuration to the declined configuration via a change in a location of the center of gravity of the user as the user moves to a lying position from an upright seated position generally aligned with the central reference plane.

3. The article of wellness furniture of claim 1 wherein the first and second ground engaging rockers are configured to enable the body support structure to transition from the horizontal configuration to an inclined configuration via a change in a location of the center of gravity of the user as the user moves to a seated forward bend position from an upright seated position generally aligned with the central reference plane.

4. The article of wellness furniture of claim 1 wherein the first and second ground engaging rockers are configured to enable the body support structure to transition from the declined configuration to the horizontal configuration via a change in a location of the center of gravity of the user as the user moves from a lying position to an upright seated position generally aligned with the central reference plane.

5. The article of wellness furniture of claim 1 wherein the first and second ground engaging rockers are configured to enable the body support structure to transition from an inclined configuration to the horizontal configuration via a change in a location of the center of gravity of the user as the user moves from a seated forward bend position to an upright seated position generally aligned with the central reference plane.

6. The article of wellness furniture of claim 1 wherein the article of wellness furniture is configured to enable the user to selectively change a degree to which the body support structure declines or inclines by adjusting the user's position along the longitudinal length of the body support structure.

7. The article of wellness furniture of claim 1 wherein each of the first and second ground engaging rockers includes an arcuate profile that is configured to enable the body support structure to transition smoothly from the horizontal configuration to the declined configuration.

8. The article of wellness furniture of claim 1 wherein each of the first and second ground engaging rockers includes an arcuate profile that is configured to enable the body support structure to transition smoothly from the horizontal configuration to an inclined configuration.

9. The article of wellness furniture of claim 1 wherein each of the first and second ground engaging rockers includes an arcuate profile that enables the angular orientation of the body support structure to range from about a fifteen degree decline to about a fifteen degree incline.

10. The article of wellness furniture of claim 1 wherein the upper support surface of the plank is between about seven to about twelve inches above the ground when in the horizontal configuration.

11. The article of wellness furniture of claim 1 wherein the first and second ground engaging rockers form a pair of laterally offset ground engaging rockers that extend from an underside of the body support structure to engage the ground along the first and second lateral sides of the article of wellness furniture.

12. The article of wellness furniture of claim 1, further comprising:

a strap coupled to the body support structure to assist the user in transitioning from a declined lying position on the body support structure to an upright seated position and/or from the upright seated position to the declined lying position.

13. The article of wellness furniture of claim 1, further comprising a plurality of transverse brace members extending between the first and second ground engaging rockers.

14. A wellness apparatus, comprising:

a body support structure comprising a plank configured to support a user in a flat lying position and having a longitudinal length between about 66 inches and about 80 inches such that, when the user lies on the plank in the flat lying position, the user's head is supported by one longitudinal end of the plank and the user's feet are supported by another longitudinal end of the plank; and a pair of laterally offset ground engaging rockers coupled to the body support structure to engage the ground along opposing longitudinal running sides of the wellness apparatus and shaped to support the body support structure at a variable angular orientation relative to the ground in response to a position of the user on the plank of the body support structure, the ground engaging rockers being oriented relative to the body support structure to enable the longitudinal ends of the plank to pitch up and down in response to the position of the user, and the ground engaging rockers being spaced apart to prevent the plank from tipping side to side as the longitudinal ends of the plank pitch up and down during use, wherein a ground engaging profile of the ground engaging rockers and an upper support surface of the plank are each symmetric about a central reference plane of the wellness apparatus that extends transverse to the plank between the opposing longitudinal running sides of the wellness apparatus to enable the wellness apparatus to be used in a bi-directional manner, wherein the upper support surface of the plank is between about five and about fourteen inches above the ground when in a horizontal configuration, and wherein each ground engaging rocker of said pair of laterally offset ground engaging rockers includes an arcuate profile having a radius of curvature between about 30 inches and about 50 inches to assist in transitioning the body support structure smoothly between the horizontal configuration and a declined configuration, and such that a center of curvature of the arcuate profile of each ground engaging rocker of said pair of laterally offset ground engaging rockers is located between about 16 inches and about 45 inches above the upper support surface of the plank.

15. The wellness apparatus of claim 14 wherein the wellness apparatus is configured such that the body support structure assumes the horizontal configuration when the wellness apparatus is in a state of equilibrium, and assumes the declined configuration when the user lies on the plank of the body support structure with a center of gravity of the user offset from the central reference plane of the wellness apparatus.

* * * * *